US007249887B2

(12) United States Patent
Kinigakis et al.

(10) Patent No.: US 7,249,887 B2
(45) Date of Patent: Jul. 31, 2007

(54) RECLOSABLE SYSTEM FOR FLEXIBLE PACKAGES HAVING INTERLOCKING FASTENERS

(75) Inventors: Panagiotis Kinigakis, Buffalo Grove, IL (US); Kenneth Pokusa, Willowbrook, IL (US); Orestes Rivero, Skokie, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 10/979,672

(22) Filed: Nov. 2, 2004

(65) Prior Publication Data

US 2005/0063619 A1 Mar. 24, 2005

Related U.S. Application Data

(62) Division of application No. 10/174,614, filed on Jun. 19, 2002, now Pat. No. 6,863,646.

(51) Int. Cl.
*B65D 33/16* (2006.01)
*A44B 19/00* (2006.01)
*B65D 33/34* (2006.01)

(52) U.S. Cl. ..... 383/61.2; 383/64; 383/203; 383/204; 383/210; 383/5; 24/399

(58) Field of Classification Search ..... 383/63, 383/64, 61.1–61.3, 5, 210, 210.1, 203, 204, 383/207, 208, 93, 95, 97
See application file for complete search history.

(56) References Cited

U.S. PATENT DOCUMENTS

| | | | | |
|---|---|---|---|---|
| 3,790,992 | A * | 2/1974 | Herz | 24/400 |
| 4,925,316 | A * | 5/1990 | Van Erden et al. | 383/210.1 |
| 5,713,669 | A * | 2/1998 | Thomas et al. | 383/204 |
| 5,954,433 | A * | 9/1999 | Yeager | 383/203 |
| 6,286,191 | B2 * | 9/2001 | Van Erden | 24/399 |
| 6,290,390 | B1 * | 9/2001 | Buchman | 383/5 |
| 6,347,885 | B1 * | 2/2002 | Buchman | 383/5 |
| 6,357,914 | B1 * | 3/2002 | Kinigakis et al. | 383/64 |
| 6,394,652 | B2 * | 5/2002 | Meyer et al. | 383/118 |
| 6,402,376 | B1 * | 6/2002 | Bois | 383/64 |
| 6,488,410 | B2 * | 12/2002 | Schneider | 383/5 |
| 6,609,828 | B2 * | 8/2003 | Schneider et al. | 383/204 |
| 6,786,640 | B2 * | 9/2004 | Schneider et al. | 383/5 |
| 6,799,890 | B2 * | 10/2004 | Schneider et al. | 383/210 |

* cited by examiner

*Primary Examiner*—Robin Hylton
(74) *Attorney, Agent, or Firm*—Fitch, Even, Tabin & Flannery

(57) ABSTRACT

A reclosable flexible package includes a reclosure having flanges joined at their upper ends to interlockable fastener tracks. The lower ends of the reclosure flanges are joined together with one of the reclosure flanges being joined to a side panel of the flexible package by a peel seal.

6 Claims, 8 Drawing Sheets

RECLOSABLE SYSTEM FOR FLEXIBLE PACKAGES HAVING INTERLOCKING FASTENERS

This is a division of prior application Ser. No. 10/174,614, filed Jun. 19, 2002, now U.S. Pat No. 6,863,646, which is hereby incorporated herein by reference in its entirety.

BACKGROUND OF THE INVENTION

1. Field of the Invention

The present invention pertains to the closure of flexible packages, such as plastic bags, and in particular to fastener closures employing sliders.

2. Description of the Related Art

With the recent emphasis in providing consumers with bulk quantities of various commodities, such as food products, reclosable packages have become increasingly popular. One of the most popular means of providing reclosability is to employ zippers of various types, particularly zippers which are compatible with flexible packages of plastic film construction. Manufacturers of food products and other commodities are concerned with filling the contents of a flexible package as quickly and economically as possible. It is important that the opening provided by the fastener be made as large as practically possible. Consumers or other end users also prefer large sized openings for easy extraction of products from the package interior. Even with large openings, however, products within the package may interfere with fastener operation when product poured or otherwise dispensed from the package becomes entrained in the fastener components.

Other improvements to flexible reclosable packages are being sought. For example, when handling products comprised of numerous small pieces, such as shredded cheese or cereal, for example, it is generally desirable to have the package formed into a pouch which is open at one end, or along one side, so as to allow product to be poured or shaken through the reclosable opening. It is desirable that the product be allowed to freely flow past the reclosable opening. Preferably, the path taken by the product within the package should be made as smooth as possible.

Although improvements have been made in the art of plastic welding and joining, manufacturers of consumer products employing high speed production techniques are continually seeking improved package forming methods and equipment. Any reduction in the time needed to form these and other package features can result in substantial cost savings.

Commercial package designs having zipper closures with peelable seals suffer from a reduction of volume capacity compared to other types of alternative packaging.

SUMMARY OF THE INVENTION

It is an object of the present invention to provide a reclosable plastic package having an optimized package volume.

Another object of the present invention is to provide a package of the above type with interlockable fastener tracks, usable with or without slider members.

A further object of the present invention is to provide a plastic package of the above type suitable for use with a shroud enclosing the interlockable fastener tracks.

These and other objects of the present invention are attained in a reclosable flexible package, comprising a reclosable flexible package, comprising: opposed front and rear package panels having sides and joined together to form an interior and a package opening communicating with said interior; first and second interlockable fastener tracks configurable in a closed position and an unlocked open position; said interlockable fastener tracks having opposed ends located adjacent said opposed sides of said front and said rear package panels; a reclosure joined to said first and said second interlockable fastener tracks, including first and second reclosure flanges having first ends joined to said first and said second interlockable fastener tracks, respectively; said first and said second reclosure flanges having a second end joined to each other; one of said first and said second reclosure flanges joined to one of said front and said rear package panels with a peel seal; first ends of said first and said second reclosure flanges joined to respective ones of said front and said rear package panels; a side seal of preselected width joining together one side of said front and said rear package panels; a slider movable along said interlockable fastener tracks to configure said interlockable fastener tracks in said interlocked position so as to close said opening and to configure said interlockable fastener tracks and said unlocked position so as to allow access through said opening to set package interior; and stops adjacent said ends of said interlockable fastener tracks to interfere with and prevent travel of said slider beyond said interlockable fastener tracks.

DETAILED DESCRIPTION OF THE PREFERRED EMBODIMENTS

Figure 1:
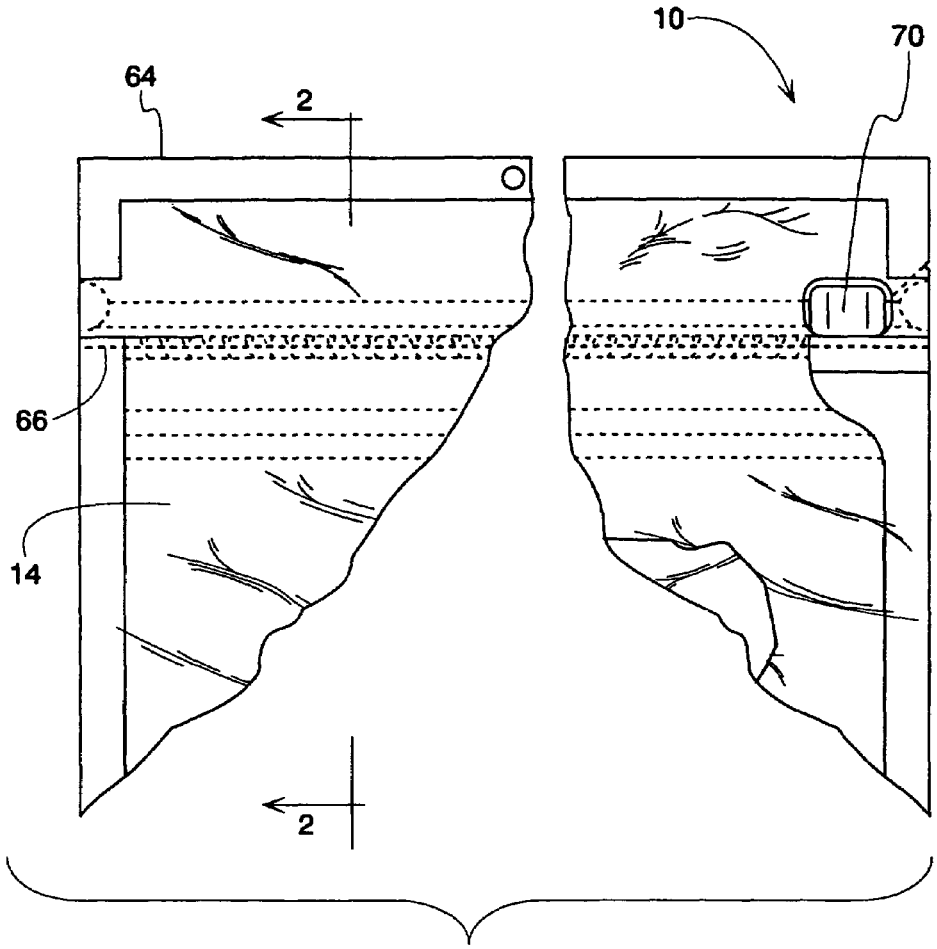
FIG. 1 is an elevational view of a reclosable flexible package according to principles of the present invention.
Figure 2:
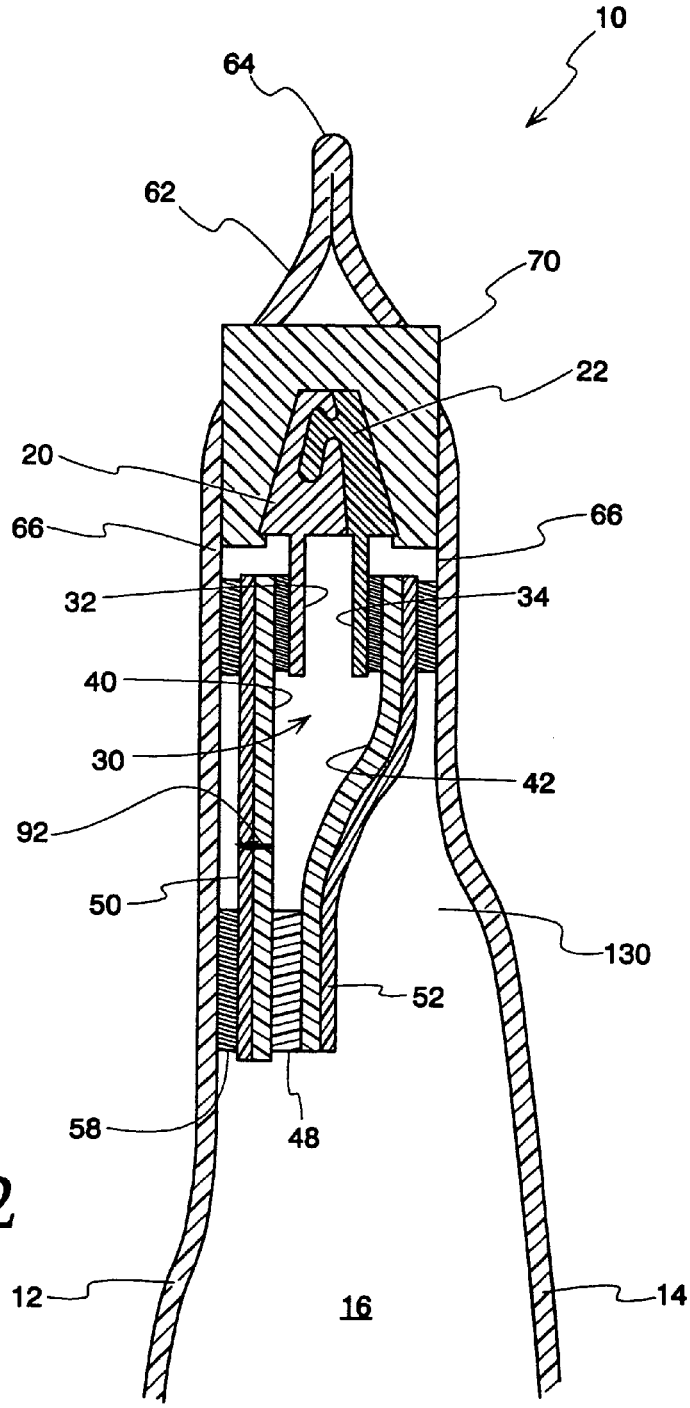
FIG. 2 is a cross-sectional view taken along the line 2—2 of FIG. 1.

Referring now to the drawings, and initially to FIGS. 1 and 2, a reclosable, flexible package 10 has opposed front and rear package panels 12, 14 joined together to form an interior 16 and a package opening adjacent the upper end of the package, communicating with the package interior. First and second interlockable fastener tracks 20, 22 are configurable between a closed position and an unlocked open position. Referring to FIG. 1, the interlockable fastener tracks have opposed ends located adjacent sides of the front and rear package panels.

A reclosure 30 is joined to the interlockable fastener tracks 20, 22 and includes fastener flanges 32, 34 joined to the interlockable fastener tracks. The reclosure 30 further includes reclosure flanges 40, 42 with upper ends attached to fastener flanges 32, 34 with a weld seal and with lower ends joined together by a weld seal 48. In the preferred embodiment, the reclosure flanges 40, 42 are covered with layers 50, 52 of metalocene of other fusion-enhancing material. The upper, first ends of the reclosure flanges 40, 42 are joined to the front and rear package panels 12, 14 with a weld or fusion seal. The lower end of reclosure flange 40 is joined to package panel 12 by a peel seal 58.

In the preferred embodiment the reclosable flexible package 10 is illustrated with an optional shroud 62 formed as an extension of package panels 12, 14 and joined together with a dead fold 64. Laser scores 66 extend along the shroud, and provide convenient separation of the shroud from the package panels, exposing the interlockable fastener tracks. If desired, the shroud can be omitted. Also illustrated in the preferred embodiment is an optional slider member 70, portions of which extend through holes formed in shroud 62, as illustrated for example in FIG. 1. If desired, the slider member 70 can be omitted.

Figure 3:
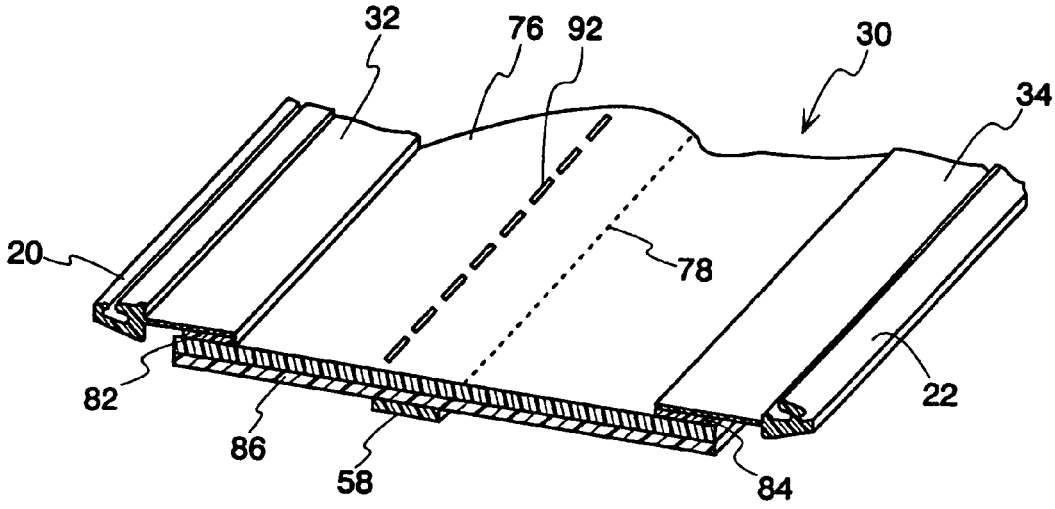
FIG. 3 is a fragmentary perspective view of a reclosure assembly thereof.

Referring now to FIGS. 3–6, construction of reclosure 30 is illustrated. Preferably, interlockable fastener tracks 20, 22 are provided with integral fastener flanges 32, 34. A film body 76 extends between the interlockable fasteners tracks and provides material for the reclosure flanges. The reclosure flanges are separated one from another by cutting the film body along cut line 78. Film body 76 is preferably severed along line 78 after fastener flanges 32, 34 are joined to the outer edges of the film body by fusion seals indicated at 82, 84. Further, it is generally preferred that peel layer 58 is joined to the film body adjacent cut line 78. As illustrated in FIG. 3, film body 76 is provided with metalocene layer 86 which, after severing along cut line 78, forms reclosure flanges 40, 42 illustrated for example in FIG. 2. Also, prior to cutting along line 78, a weakening line 92 is formed to one side of peel layer 58. The weakening line 92 may take any suitable form, but preferably comprises a line of perforations.

Figure 4:
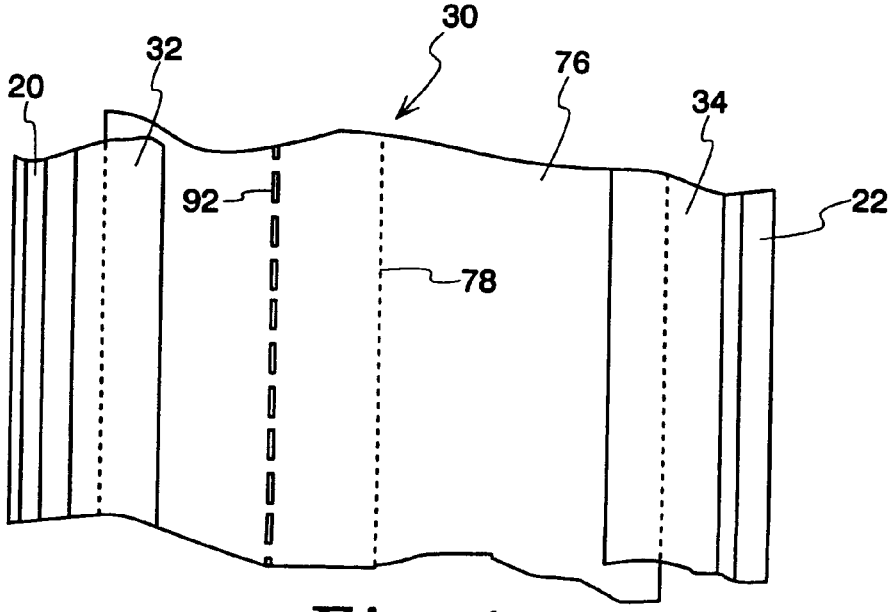
FIG. 4 is a top plan view thereof prior to welding assembly.
Figure 5:
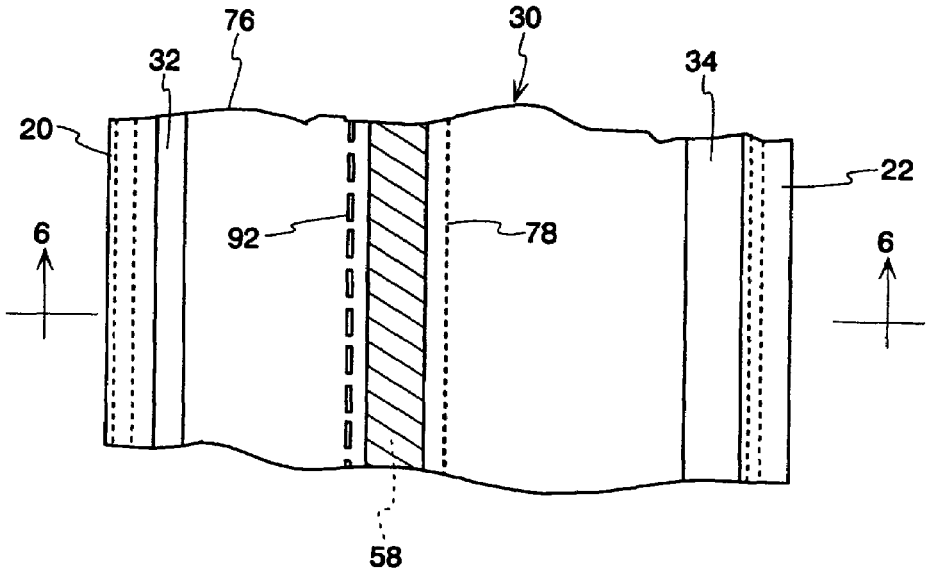
FIG. 5 is a top plan view thereof after welding assembly.
Figure 6:
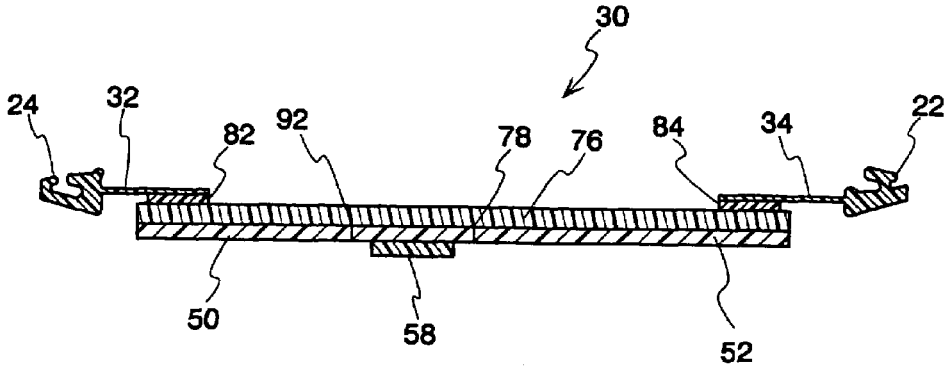
FIG. 6 is a cross-sectional view taken along the line 6—6 of FIG. 5.

FIG. 4 shows the preferred method of construction, with weakening line 92 formed in film body 76, prior to joiner with the fastener flanges 32, 34. If desired, the peel layer 58 can be provided either prior to joining of the fastener flanges 32, 34 with the film body 76, or later, after the fastener flanges 32, 34 are joined to the film body 76 as shown in FIG. 5. A cross-section of the completed reclosure 30 is illustrated in FIG. 6.

Referring now to FIGS. 7–10, the preferred method of assembling the reclosable flexible package is illustrated. Preferably, the front and rear package panels and the optional shroud is provided as a continuous film sheet folded at its bottom end to form the dead fold 64. The reclosure 30 is provided as a continuous sheet, attached to the interlockable fastener tracks, as described above. Seal bars 102–108 are provided to join the reclosure to the package panels. Preferably, the seal bars operate as opposed pairs, drawn together to press the film components of the reclosable, flexible package together, for desired joining. Seal bar 102 is maintained at a relatively low temperature while the remaining seal bars 104–108 are maintained in a "hot" condition suitable for fusion seal formation. Opposed seal bars 102, 104 cooperate together to form the fusion seal 48 between reclosure flanges 40, 42 and the peel seal 58 formed between reclosure flange 40 and package panel 12.

Figure 7:
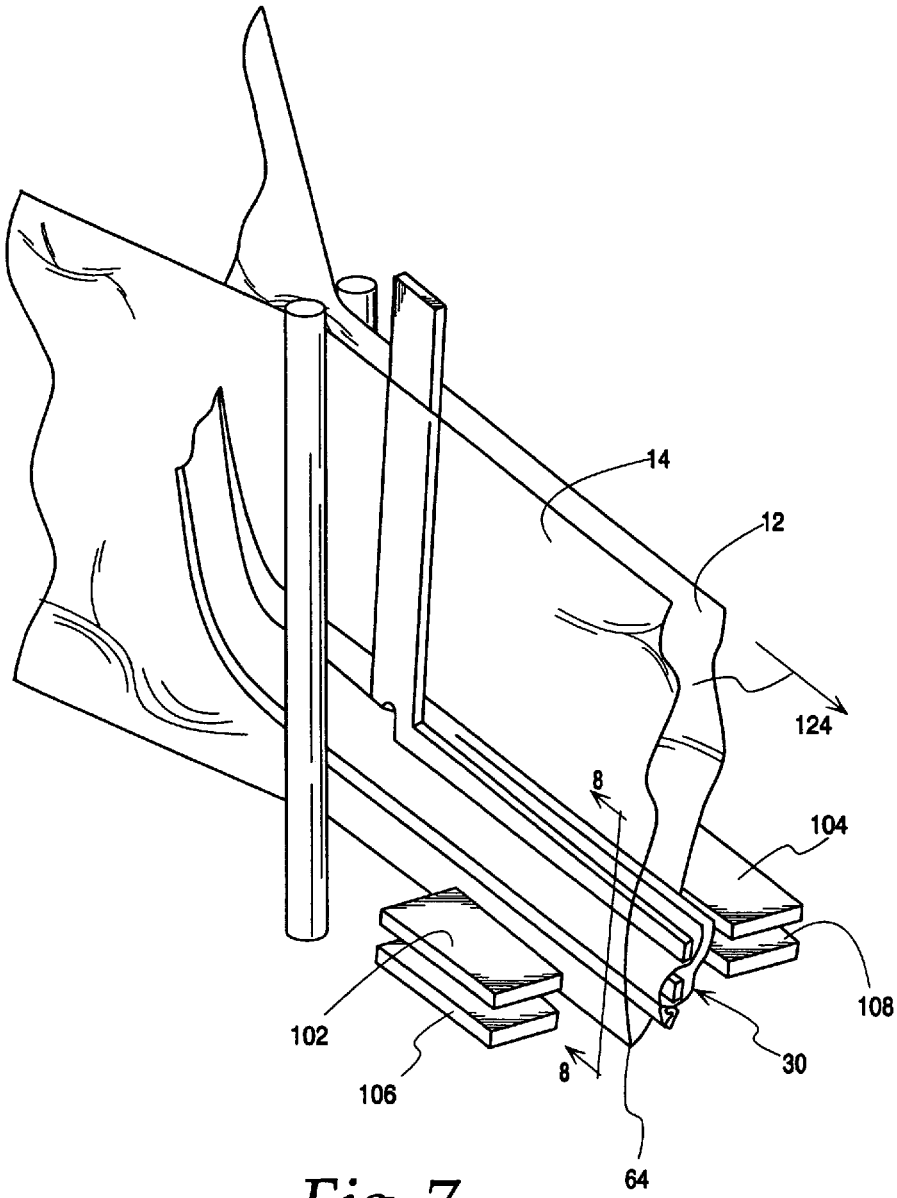
FIG. 7 is a fragmentary perspective view showing a method of making the reclosable flexible package.
Figure 9:
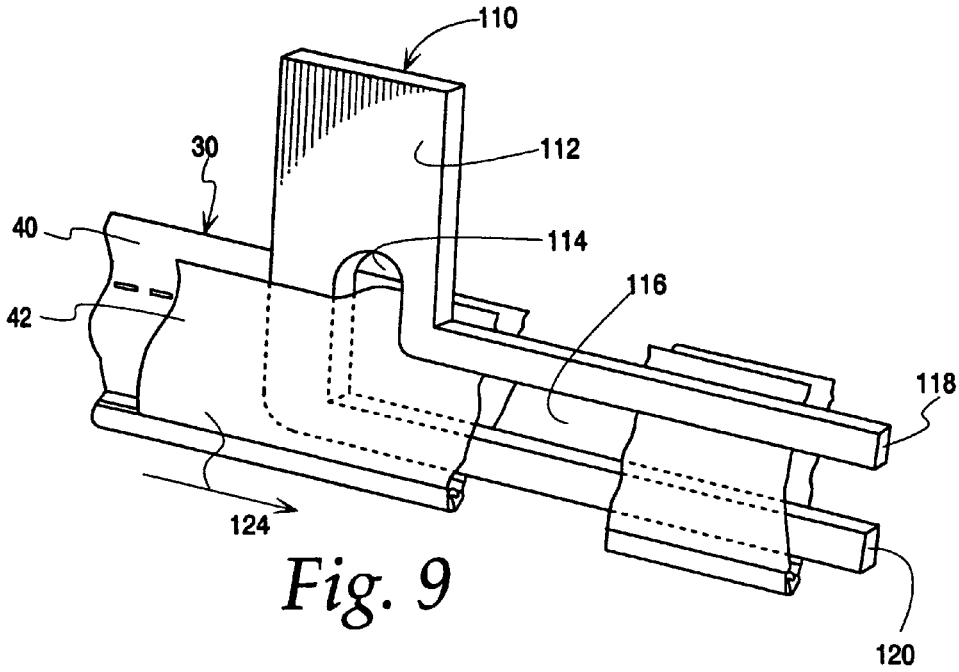
FIG. 9 is a fragmentary perspective view of a portion of FIG. 7.
Figure 10:
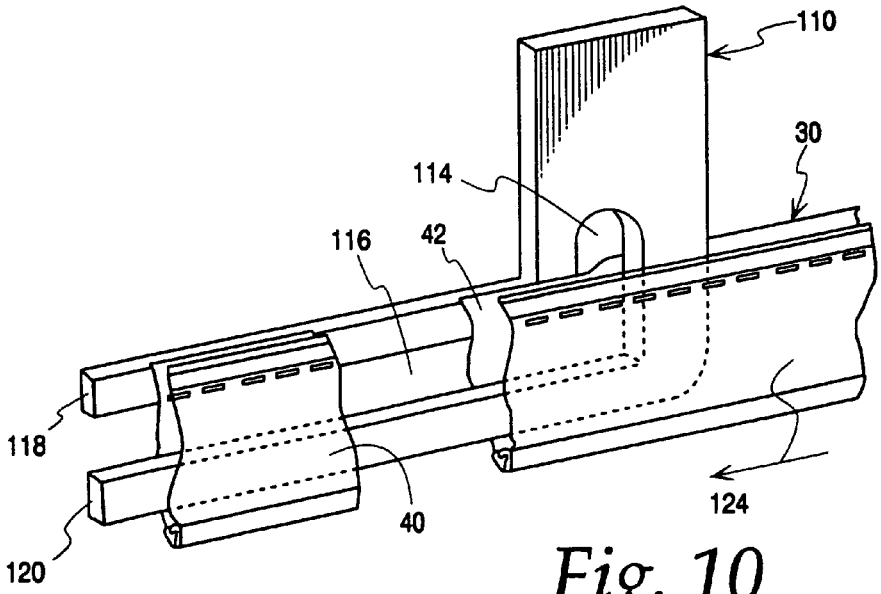
FIG. 10 is another perspective view thereof.

During the sealing operation, a tool 110 is employed, in a manner illustrated in FIGS. 7, 9 and 10. Tool 110 includes a body portion 112 defining a vertically extending opening 114 communicating with a horizontal opening 116 formed between cantilevered fingers 118 and 120. As can be seen for example in FIGS. 9 and 10, fingers 118, 120 receive cantilever support from body 112 and are terminated in free ends at their downstream portion, relative to the direction of travel 124 of the reclosable, flexible package components.

Figure 8:
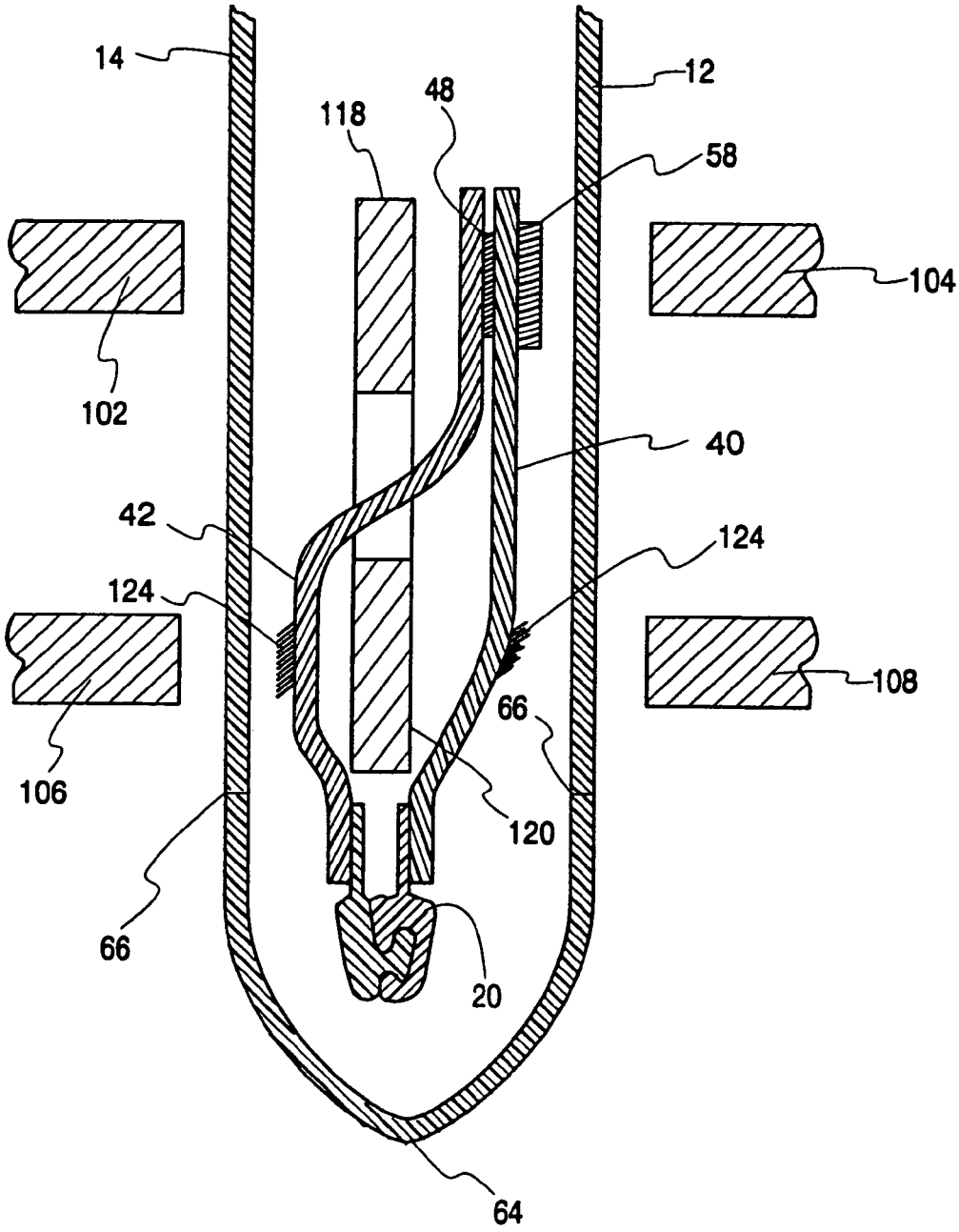
FIG. 8 is a fragmentary cross-sectional view taken along line 8—8 of FIG. 7.

Referring to FIG. 8, it can be seen that the "cold" seal bar 102 presses against package panel 14 and upper finger 118 to provide backing support for the "hot" seal bar 104 which forms peel seal 58 between package panel 12 and reclosure flange 40, and fusion seal 48 between the opposed face of reclosure flange 42 and reclosure flange 42. The remaining pair of seal bars, "hot" seal bars 106, 108, form a fusion seal 124 between the package panels 12, 14 and their respective reclosure flanges 40, 42. In FIG. 8, the fusion seals 48, 124 are schematically indicated for illustrative purposes, it being understood that the fusion seal is formed by direct contact of one film component to another without intervening seal material. It can be seen in FIG. 8 that finger 120 of tool 110 prevents unintentional fusion of flanges 42 and 40.

Referring to FIGS. 7, 9 and 10, it is generally preferred that the reclosure 30 be continuously mated with the package panels, for joining in a continuous sealing operation. As illustrated, the reclosure flange 42 passes through vertical opening 114 and horizontal opening 116 in tool 110 such that the free end is presented for contact with reclosure flange 40, to form the fusion seal 48.

It can be seen that the method of assembly includes providing a tool member 110 having a body portion 112 defining a vertical opening 114, generally normal to the direction of web travel. Tool member 110 includes fingers 118, 120 extending in a generally horizontal direction and forming horizontal opening 116 therebetween, it being understood that the horizontal direction is the direction of web travel. One of the reclosure flanges is guided through the normally extending opening 114 and the opening extending in the direction of web travel, 116 to bring the free ends of the reclosure flanges together for fusion sealing. In one aspect, the fingers 118, 120 provide backing support for the sealing operations.

Figure 11:
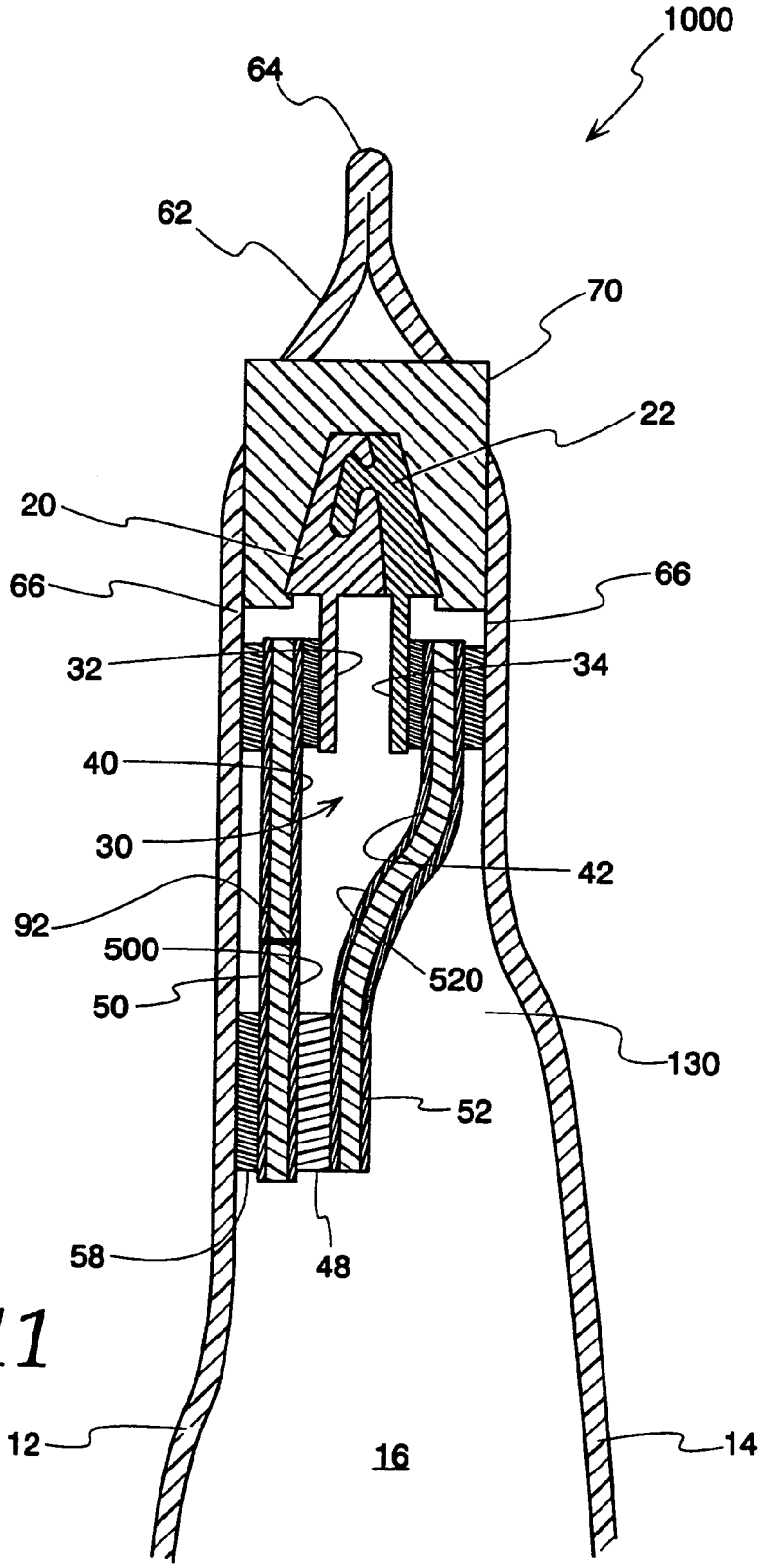
FIG. 11 is a cross-sectional view similar to that of FIG. 2, but showing an alternative reclosable, flexible package according to principles of the present invention.

Turning now to FIG. 11, an alternative embodiment of a reclosable, flexible package is generally indicated at 1000. The reclosable, flexible package 1000 is substantially identical to reclosable, flexible package 10 described above, except that reclosure flanges 40, 42 are double-faced with a metalocene or other fusion-enhancing outer layer. As can be seen from FIG. 11, the metalocene layers 500, 520 oppose each other and, upon the application of tooling to carry out a fusion operation, are joined directly together to form a fusion seal 48, indicated in FIG. 11. In the reclosable, flexible package 1000, there is an enhanced difference between the failure strength of fusion seal 48 and the weakened portion 92, formed by perforation or other weakening of reclosure flange 40 and the layers 50, 500 associated therewith. Accordingly, further assurance is provided that, upon a conventional opening operation, internal components of the reclosable, flexible package will separate in the desired manner, at the line of weakening 92 and the peel seal 58. Thus, desired opening of the reclosable, flexible package is further assured. As mentioned above, with reference to FIGS. 1–10, it has not been found necessary to provide opposed, or inwardly facing fusion-enhancing layers on the reclosure tracks 40, 42. That is, direct fusion between the reclosure flanges 40, 42 at fusion seal 48 has been found adequate in those applications to assure desired opening of the package at the line of weakening 92 and the peel seal 58 without the addition of fusion-enhancing layers 500, 520.

As can be seen from the above, the reclosable, flexible package described above can be employed with interlockable fastener tracks with or without a slider feature. Preferably, the interlockable fastener tracks comprise interlocking profiles with integral heat seal flanges extending from each profile. Each flange of the interlocking fastener tracks is fusion sealed to a respective side panel of the flexible package. A weakening line, preferably a perforation or a laser score line is located on the first reclosure flange, to one side of its fused section. A peelable layer is co-extruded onto the first flange adjacent the line of weakening and on the side facing the adjacent side panel of the flexible package. The peel seal is made between the peelable layer and the flexible package panel. As seen, the two reclosure flanges are fusion sealed to each other at their free ends, at a point below the line of weakening, and opposite to the peel layer. The remaining, second reclosure flange remains unattached to its adjacent side panel of the flexible package.

The present invention can be readily employed with various commercially available interlockable fastener tracks, sometimes referred to as "zipper" tracks. The present invention can be employed with interlockable fastener tracks containing peelable layers on the interior surface of their fastener flanges. The present invention allows hermetic sealing of the flexible package below the interlockable fastener tracks, since the fusion seal of the exterior surface of the fastener flanges against the side panels of the flexible package are typically insufficient to provide required hermeticity. Notably, the present invention solves a prevailing problem of reclosable fastener tracks reducing the volume capacity of the flexible package. Reduced volume capacity results in higher material costs, slower filling speeds, inconsistent peel force to open the flexible package, and a reduced burst strength when the package is exposed to low barometric pressure conditions frequently encountered in high altitude warehousing and distribution markets.

With reference to FIG. 2, it can be seen that the present invention provides an extra package interior volume indicated by reference numeral 130, formed between reclosure flange 42 and the upper portion of flexible package panel 14. Accordingly, with the present invention, several additional advantages are obtained. For example, the volume capacity of the flexible package for bottom filling operations is increased to attain a competitive advantage associated with packaging systems which do not employ peelable fasteners. The filling speed for bottom filling operations is increased by allowing product to reach the space indicated by reference numeral 130 in FIG. 2, behind the peel layer at the deepest end of the fastener flanges (fastener flange 34 in FIG. 2). Further, the first opening of the flexible package is associated with breaking the perforation 92 (shown for example in FIG. 2) while the force to break the peel seal does not depend upon the width of the peelable extrudate. If desired, the peelable extrudate may be reduced to a narrow line that provides a continuous hermetic seal across the width of the flexible package. As a further advantage, the burst strength of the bag is increased because the stress point has moved from the peelable bond to the fusion bond between the reclosure flange exterior layer and adjacent the side panel of the flexible package. In other aspects, the present invention can be readily employed in the retrofit conversion of existing equipment to allow economical fitting of the tool member 110 shown for example in FIGS. 9 and 10.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed:

1. A reclosable flexible package, comprising:

opposed front and rear package panels having sides and joined together to form an interior and a package opening communicating with said interior;

first and second interlockable fastener tracks configurable in a closed position and an unlocked open position;

said interlockable fastener tracks having opposed ends located adjacent said sides of said front and said rear package panels;

a reclosure joined to said first and said second interlockable fastener tracks, including first and second reclosure flanges having first ends joined to said first and said second interlockable fastener tracks, respectively;

said first and said second reclosure flanges having second ends joined to each other;

one of said first and said second reclosure flanges joined to one of said front and said rear package panels with a peel seal;

first ends of said first and said second reclosure flanges joined to respective ones of said front and said rear package panels;

a side seal of preselected width joining together one side of said front and said rear package panels;

a slider movable along said interlockable fastener tracks to configure said interlockable fastener tracks in said interlocked position so as to close said opening and to configure said interlockable fastener tracks in said unlocked position so as to allow access through said opening to said package interior; and stops adjacent said ends of said interlockable fastener tracks to interfere with and prevent travel of said slider beyond said interlockable fastener tracks.

2. The reclosable flexible package of claim 1 further comprising a shroud covering said slider and at least a major portion of said interlockable fastener tracks.

3. The reclosable flexible package of claim 2 further comprising weakening portions extending adjacent said interlockable fastener tracks for severing of said shroud in preparation for removal of said shroud from the remainder of said reclosable flexible package.

4. The reclosable flexible package of claim 2 wherein said shroud covers the substantial entirety of said interlockable fastener tracks.

5. The reclosable flexible package of claim 2 wherein said shroud defines openings for said slider.

6. The reclosable flexible package of claim 1 wherein said one of said first and second reclosure flanges joined to one of said front and said rear package panels with a peel seal has a weakened area between said peel seal and said first end of said one of said first and said second reclosure flanges.

* * * * *